US005511282A

United States Patent [19]

Metzger et al.

[11] Patent Number: 5,511,282

[45] Date of Patent: Apr. 30, 1996

[54] MOTOR MOUNTING ARRANGEMENT AND METHOD FOR A VACUUM CLEANER

[75] Inventors: Eric R. Metzger, Sand Lake; Gary L. Smith, Belding, both of Mich.

[73] Assignee: Bissell Inc., Grand Rapids, Mich.

[21] Appl. No.: 421,402

[22] Filed: Apr. 13, 1995

[51] Int. Cl.[6] ..... A47L 9/22

[52] U.S. Cl. ..... 15/412; 15/351

[58] Field of Search ..... 15/412, 339, 350, 15/351

[56] References Cited

U.S. PATENT DOCUMENTS

| | | | |
|---|---|---|---|
| 2,300,938 | 11/1942 | Lang et al. . | |
| 2,633,596 | 4/1953 | Turner et al. | 15/350 X |
| 2,898,621 | 8/1959 | Vance | 15/412 X |
| 2,987,241 | 6/1961 | Lindsjo et al. . | |
| 4,959,885 | 10/1990 | Sovis et al. | 15/412 X |
| 5,093,956 | 3/1992 | Saunders et al. . | |
| 5,279,018 | 1/1994 | Glenn, III . | |
| 5,414,893 | 5/1995 | Hampton et al. | 15/412 |

*Primary Examiner*—Chris K. Moore
*Attorney, Agent, or Firm*—Varnum, Riddering, Schmidt & Howlett

[57] ABSTRACT

An arrangement for mounting a motor and fan unit to a support chassis within a vacuum cleaner housing includes a support structure defining an opening for receiving a first mounting portion on a back end of the motor and fan unit, a support member having a recessed portion for receiving a second mounting portion on a front end of the motor and fan unit and a flexible locking tab having an opening and being movable between engaging and disengaging positions relative to the motor and fan unit for receiving in the opening of the locking tab the second mounting portion on the front end of the motor and fan unit when the locking tab is in the engaging position. The mounting arrangement also includes a retaining structure which is movable between assembled and disassembled condition relative to the locking tab. The retaining structure includes a bracket which faces an outside face of the locking tab so as to block the movement of the locking tab from the engaging to the disengaging position when the retaining structure is in the assembled condition.

22 Claims, 2 Drawing Sheets

MOTOR MOUNTING ARRANGEMENT AND METHOD FOR A VACUUM CLEANER

BACKGROUND OF THE INVENTION

1. Field of the Invention

The present invention generally relates to mounting arrangements for the motors of vacuum cleaners and, more particularly, is concerned with a motor mounting arrangement and method for a vacuum cleaner which employs no loose parts and stationarily secures the motor within a housing of the vacuum cleaner.

2. Description of the Prior Art

Most upright vacuum cleaners have a motor mounting arrangement in a base compartment. Many of these vacuum cleaners utilize a securing means to hold the motor in place within a housing. Most securing means require fasteners such as screws or bolts and other loose parts. A typical design mounts the motor to a chassis within a housing by connecting a cylindrical boss at each end of the motor to a pair of semi-cylindrical saddles sized to cooperate with the pair of bosses. The pair of saddles are generally formed in the housing and a pair of semi-cylindrical caps are secured by screws or bolts to the saddles to form a cylindrical bearing surface for each boss. A problem with this typical design, however, is that the fasteners and other loose parts increase the complexity and time required for securing the motor within the housing.

A variety of mounting arrangements have therefore been developed over the years to address the problems associated with installing motors within vacuum cleaner housings. Representative examples of these mounting arrangements are disclosed in U.S. Pat. No. 2,300,938 to Lang et al., U.S. Pat. No. 2,987,241 to Lindsjo et al., U.S. Pat. No. 5,093,956 to Saunders et al. and U.S. Pat. No. 5,279,018 to Glenn, III. The Lang patent discloses an elastomeric ring, a semi-circular clamp and screws for mounting a motor within a vacuum cleaner housing. The Lindsjo patent discloses an elastomeric suspension member and sheet metal straps for securing a motor within a housing. The Saunders patent discloses a housing which snaps together to secure a motor having a bearing ring supported by a semi-circular mount formed in the base of the housing with a lock ring which snaps-fit onto the semi-circular mount and bearing ring. The Glenn, III patent discloses a housing having a pair of semi-circular motor supports formed therein and a semi-circular clamp having a pair of outwardly extending flanges to be fastened to one of the motor supports by screws and a locking ring for attachment to the other motor support.

While each of the mounting arrangements disclosed by the above mentioned patents attempts to improve upon the prior methods for securing motors within vacuum cleaners, one or more of the above mentioned problems exists in each of the disclosed patents. The mounting arrangement either has many parts which fail to reduce the complexity and time required for installation of the motor or fails to effectively limit lateral or axial displacement of the motor within the vacuum cleaner housing.

Consequently, a need still exists for an improved mounting arrangement for securing a motor within a vacuum cleaner which will overcome the aforementioned problems.

SUMMARY OF THE INVENTION

The present invention provides a motor mounting-arrangement and method designed to satisfy the aforementioned need. The arrangement and method of the present invention simplifies the task of mounting the motor within the vacuum cleaner by employing no loose parts which decreases the number and complexity of the steps involved and time required to perform the task of mounting the motor within the vacuum cleaner. The arrangement and method also ensures that the motor cannot move laterally nor axially and will remain securely in place once mounted inside the housing of the vacuum cleaner.

Accordingly, the present invention is directed to an arrangement for mounting a motor for use in a vacuum cleaner. The motor mounting arrangement comprises: (a) a support substrate; (b) a support structure attached to the support substrate and defining an opening for receiving a first mounting portion on a first end of the motor; (c) a support member attached to the support substrate and being spaced from the support member and having a recessed portion for receiving a second mounting portion on a second end of the motor; and (d) a flexible locking tab attached to the support substrate and being disposed adjacent to the support member and movable between engaging and disengaging positions relative to the support member and the second mounting portion of the motor, the locking tab having an opening for receiving the second mounting portion of the motor when in the engaging position. The locking tab is spaced outwardly from the support member and bears against a shoulder on the second mounting portion of the motor when the first mounting portion of the motor is received by the opening of the support structure and the second mounting portion of the motor is received by the recessed portion of the support member.

More particularly, the support member further has a web portion attached to the support substrate with the recessed portion of the support member formed on an upper end of the web portion thereof. The recessed portion includes a concave surface for receiving the second mounting portion of the motor.

The locking tab has a lower base portion attached to the support substrate and an upper locking portion having a pair of upright fingers defining the opening through the locking tab. The fingers are attached to and extend upwardly from the lower base portion and curve inwardly toward one another so as to overlie the second mounting portion of the motor received through the opening of the locking tab when the locking tab is in the engaging position. The fingers of the upper locking portion define a passage through the upper locking portion to the opening of the locking tab for moving an end portion of a shaft of the motor extending outwardly from the second mounting portion of the motor through the passage to the opening while the locking tab is in the disengaging position.

The locking tab is biased to the engaging position and can be flexed outwardly to the disengaging position so as to permit the end portion of the motor shaft to pass downwardly through the passage and to permit alignment of the second mounting portion of the motor with the opening of the locking tab for insertion therein when the locking tab upon release returns to the engaging position against the shoulder of the second mounting portion of the motor.

The motor mounting arrangement further comprises a retaining bracket movable between assembled and disassembled conditions relative to the locking tab to prevent flexing of the locking tab from the engaging position. The retaining bracket has a first surface facing a side of the locking tab that faces away from the flange on the second mounting portion of the motor. The one surface of the retaining means blocks the movement of the locking tab from the engaging position to the disengaging position when the retaining means is in the assembled condition.

Also, the present invention is directed to a method for mounting a motor for use in a vacuum cleaner. The mounting method comprises the steps of: (a) providing a mounting arrangement including a support structure defining an opening for receiving a first mounting portion of a first end of the motor, a support member spaced from the support structure and having a recessed portion for receiving a second mounting portion of a second end of the motor, and a flexible locking tab disposed adjacent to the support member and movable between engaging and disengaging positions relative to the second mounting portion and having an opening for receiving the second mounting portion when in the engaging position, the support structure, support member and locking tab of the mounting arrangement being aligned along a common support axis having a length relatively greater than the axial length of a body portion of the motor disposed between the first and second mounting portions thereof; (b) moving the motor at an angle to the support axis for partial engagement of the first mounting portion of the motor into the opening of the support structure; (c) moving the locking tab outwardly from the support member to the disengaging position; (d) pivoting the motor downward toward the support axis to place the second mounting portion of the motor onto the recessed portion of the support member and concurrently moving the first mounting portion of the motor further into the opening in the support structure; and (e) releasing the flexible locking tab inwardly from the disengaging position to the engaging position so as to lock the second mounting portion of the motor in the opening of the locking tab.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
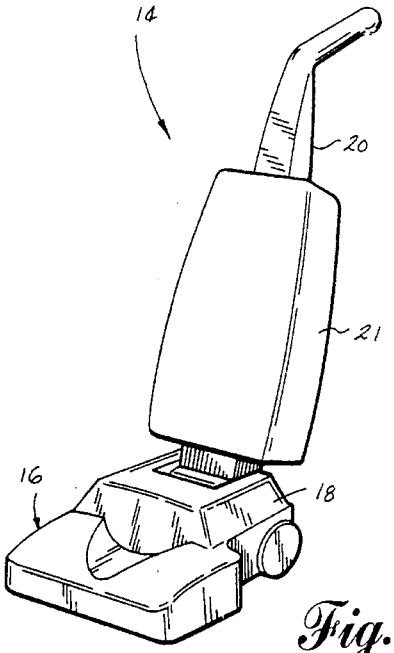
FIG. 1 is a perspective view of a vacuum cleaner having a base compartment in which a motor mounting arrangement of the present invention is used to mount a motor therein.
Figure 2:
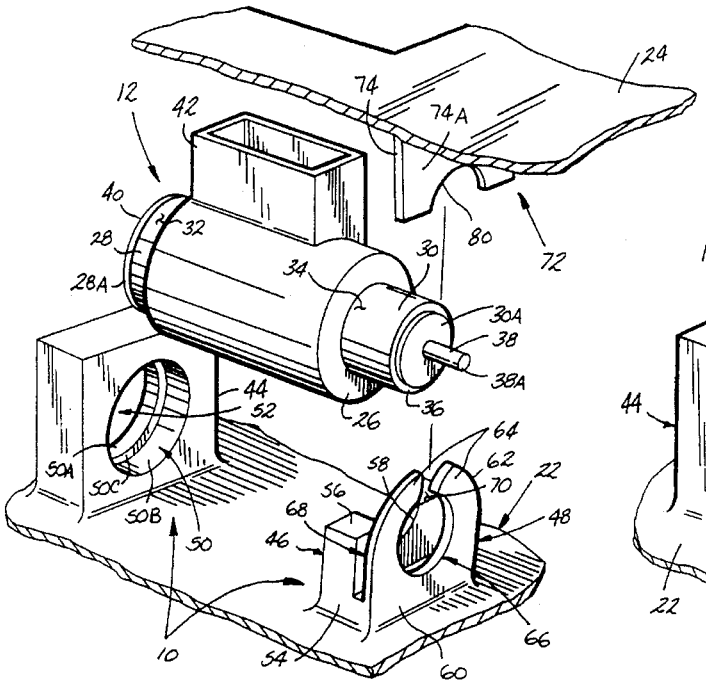
FIG. 2 is an exploded perspective view of the motor mounting arrangement of the present invention in a disassembled condition.
Figure 3:
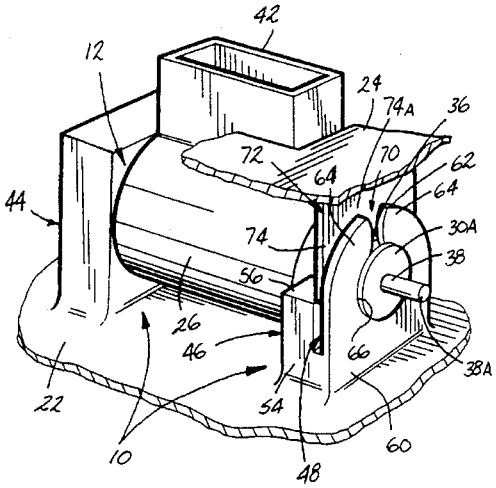
FIG. 3 is a perspective view of the motor mounting arrangement in an assembled condition with the cover broken away.

Referring to the drawings and particularly to FIGS. 1 to 3, there is illustrated an arrangement, generally designated 10, of the present invention for mounting a motor and fan unit 12. The mounting arrangement 10 is particularly suited for use in conjunction with an upright vacuum cleaner 14 although other uses thereof will fall within the purview of the present invention.

The upright vacuum cleaner 14 generally includes a base 16 which provides a foot cleaner assembly 18 having a handle 20 pivotally attached thereto and mounting a dirt collector 21 which can be a hard housing or a flexible bag. The handle assembly 20 is generally pivotable between the upright condition, as shown in FIG. 1, to a rearwardly inclined orientation typically used when the vacuum is in operation. The foot cleaner assembly 18 basically includes the motor and fan unit 12, operable for generating sufficient flow of air to create a suction condition under the foot cleaner assembly 18 for lifting and routing dirt and foreign matter through a vacuum nozzle (not shown) into the dirt collector bag 21. The foot cleaner assembly 18 also includes a support substrate in the form of a support chassis 22 and a cover 24 (being only fragmentarily illustrated in FIGS. 2–6) which are assembled together to form a housing for enclosing and protecting the motor and fan unit 12. The foot cleaner assembly 18 can also include a rotatable brush (not shown) to agitate dirt in carpeting for removal by the suction of the fan.

The motor and fan unit 12 is generally cylindrical in shape and has a body portion 26 disposed between a first mounting portion 28 on a rear end thereof and a second mounting portion 30 on an opposite front end thereof. Each of the first and second mounting portions 28, 30 has a diameter relatively smaller than the diameter of the body portion 26. Both mounting portions 28, 30 have respective outer cylindrical surfaces 32, 34, respectively, with the diameter of the second mounting portion 30 being relatively smaller than the diameter of the first mounting portion 28. The second mounting portion ends with a shoulder 36 and an outer end 30A of slightly smaller diameter than the diameter of cylindrical surface 34. The motor and fan unit 12 also includes a central rotary output shaft 38 having an end portion 38A extending through and outwardly from the second mounting portion 30 for driving a rotary brush (not shown) through a pulley and belt arrangement in conventional fashion. Its diameter is relatively smaller than the second mounting portion 30. Finally, the motor and fan unit 12 incorporates a fan or blower which draws in a flow of air axially through an inlet 40 formed in the first mounting portion 28 and discharges the flow of air tangentially through an outlet 42 extending from the body portion 26 of the motor and fan unit 12.

Referring now to FIGS. 2–6, the motor mounting arrangement 10 of the present invention basically includes a support structure 44, a support member 46 and a flexible locking tab 48, all being attached on and extending upright from the support chassis 22. The support structure 44, support member 46 and flexible locking tab 48 are made of a suitable material, such as a plastic material, and preferably made by a well-known injection molding technique, preferably involving the integral molding thereof with the support chassis 22.

Figure 6:
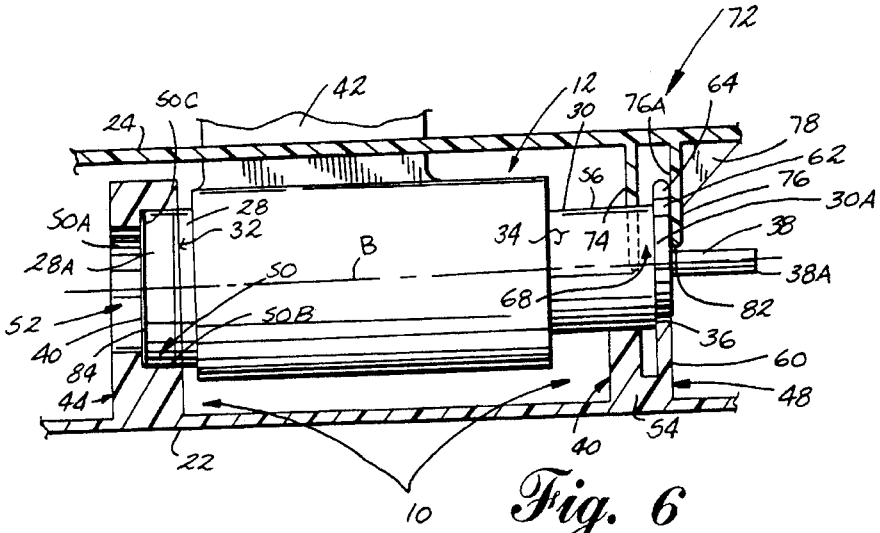
FIG. 6 is an axial sectional view of the motor mounting arrangement in the assembled condition.

The support structure 44 of the motor mounting arrangement 10 is generally rectangular in shape having a greater height than width. The support structure 44 is attached at its lower end on the support chassis 22 and has a cylindrical bore 50 spaced above the support chassis 22. The cylindrical bore 50 defines an opening 52 therethrough which extends through the entire width of the support structure 44 and opens at the respective outside and inside ends 50A, 50B of the bore 50. The bore 50 also is relatively smaller in diameter at the outside end 50A than at the inside end 50B thereof so as to define an annular shoulder 50C therein facing toward the support member 46. The bore 50 is sized relative to the outer cylindrical surface 32 of the first mounting portion 28 of the motor and fan unit 12 so that the support structure 44 is adapted to snugly receive and retain the first mounting portion 28 partially through the opening 52 of the support structure 44 in abutment against the shoulder 50C in the bore 50, as shown in FIG. 6. There is an annular elastomeric seal 84 mounted in the end of the first mounting portion 28 to seal the first mounting portion 28 to the annular shoulder 50C to prevent air (vacuum) leakage at the joint.

The support member 46 of the motor mounting arrangement 10 has a lower web portion 54 being generally rectangular in shape and attached on the chassis 22. The support member 46 also has an upper recessed portion 56 defining an upwardly facing semi-cylindrical concave support surface 58 which conforms in shape to the shape of the outer cylindrical surface 34 of the second mounting portion 30 of the motor and fan unit 12. The support member 46 is spaced from the support structure 44 through a distance greater than the axial length of the body portion 26 of the motor and fan unit 12 so as to easily accommodate the insertion of the body portion 26 between the support structure 44 and support member 46. More specifically, the distance between the support structure 44 and the support member 46 is preset so that the upper recessed portion 56 of the support member 46 will receive and seat the second mounting portion 30 of the motor and fan unit 12 thereon with the annular shoulder 36 being located adjacent to the flexible locking tab 48 and with the outer end 28A of the first mounting portion 28 being received within the opening 52 of the support structure 44 and abutting against the shoulder 50C therein with seal 84 positioned therebetween.

Figure 5:
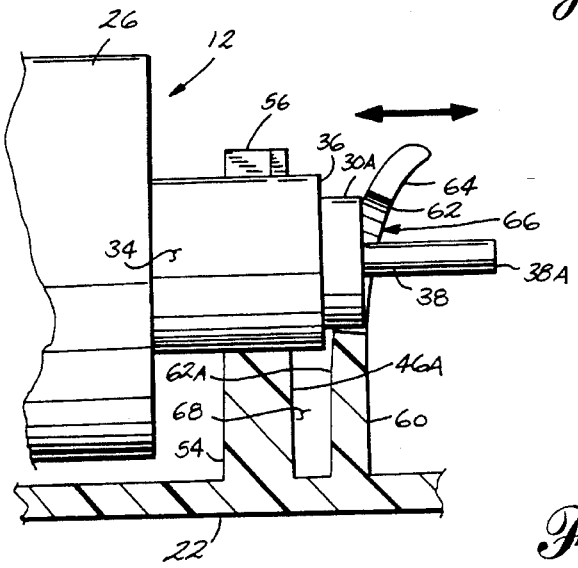
FIG. 5 is an enlarged fragmentary axial sectional view of the motor mounting arrangement showing a further step in mounting the motor to the motor mounting.

The flexible locking tab 48 of the motor mounting arrangement 10 has a lower base portion 60 attached on the support chassis 22 and an upper locking portion 62 having a pair of upright fingers 64 defining an opening 66 through the upper locking portion 62 of the locking tab 48. The diameter of the opening 66 is of such a size relative to the outer cylindrical surface 34 of the second mounting portion 30 of the motor and fan unit 12 so as to adapt the opening 66 to receive the outer end 30A of the second mounting portion 30 therethrough with the shoulder 36 located adjacent to an inner face surface 62A of the upper locking portion 62 of the support member 46. The locking tab 48 is disposed adjacent to the support member 46 and can be flexed, as shown in FIG. 5, in order to move the locking tab 48 between engaging and disengaging positions relative to the second mounting portion 30 of the motor and fan unit 12, as shown respectively in FIGS. 5 and 6. The locking tab 48 received the outer end 30A of the second mounting portion 30 of the motor and fan unit 12 through the opening 66 of the locking tab 48 when the locking tab 48 is in its engaging position, as shown in FIG. 6.

The pair of upright fingers 64 of the upper locking portion 60 of the locking tab 48 extend upwardly from the lower base portion 60 and curve inwardly toward one another so as to surround and overlie the outer end 30A of the second mounting portion 30 of the motor and fan unit 12 when the locking tab 48 is in the engaging position. The locking tab 48 also is spaced outwardly from the support member 46 so as to define a channel 68 therebetween. The spacing of the locking tab 48 from the support structure 44 is preset such that motor and fan unit 12 will snugly engage the annular shoulder 50C at one end and the inner facing surface 62A of the locking tab 48 so as to prevent the motor and fan unit 12 from shifting laterally or axially once mounted in the motor mounting arrangement 10.

The upright fingers 64 of the upper locking portion 62 of the locking tab 48 further define a passage 70 through the upper locking portion 62 to the opening 66 for passing the end portion 38A of the motor shaft 38 downwardly through the passage 70 to the opening 66 after the locking tab 48 is flexed to and held at its disengaging position away from the support member 46. Such movement of the motor shaft 38 through the passage 70 and into the opening 66 permits the alignment of the second mounting portion 30 with the opening 66 for insertion therein when the locking tab 48 is returned to the engaging position to retain the annular flange 36 of the second mounting portion 30 within the channel 68 defined between the support member 46 and the locking tab 48. The flexible locking tab 48, as fabricated with the support chassis 22, is disposed in the engaging position. The resiliently flexible locking tab 48 is inherently biased to naturally move to the engaging position when it is released.

Referring to FIGS. 2, 3 and 6, the motor mounting arrangement 10 of the present invention further includes a retaining means 72 being movable between assembled and disassembled conditions relative to the locking tab 48 and the annular shoulder 36 on the second mounting portion 30 of the motor and fan unit 12. Preferably, the retaining means 72 includes the cover 24 and a pair of side-by-side spaced inner and outer brackets 74, 76 attached on the cover 24. For reasons of clarity, the outer bracket 76 is omitted in FIGS. 2 and 3. The attachment of the outer bracket 76 to the cover 24 is reinforced by the provision of a gusset 78, as shown in FIG. 6, extending in transverse relation to and being attached to the outer bracket 76 and cover 24. The outer bracket 76 has a surface 76A thereon facing an outer side 48A of the locking tab 48 on the second mounting portion 30 of the motor and fan unit 12. The outer bracket 76 thus will block any movement of the locking tab 48 from the engaging position to the disengaging position after the cover 24 is placed in an assembled condition with the support chassis 22, as represented by their relative positions in FIG. 6. Also, the inner and outer brackets 74, 76 each has a generally semi-cylindrical recess 80, 82 defined in the lower ends thereof adapting the brackets to overlie and interfit with the outer cylindrical surface 34 of the second mounting portion 30 of the motor and fan unit 12.

Figure 4:
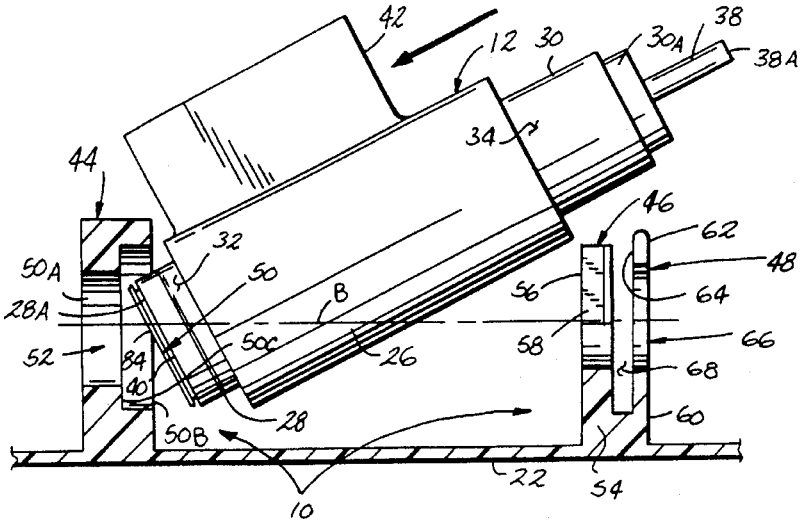
FIG. 4 is an axial sectional view of the motor mounting arrangement in the disassembled condition and illustrating the assembly of the motor to the mounting.

Referring now to FIGS. 4 to 6, there is illustrated the method steps involved in using the above-described motor mounting arrangement 10 to mount the motor and fan unit 12 in a housing formed by the support chassis 22 and cover 24 located in the base 16 of the upright vacuum cleaner 14. As seen in FIG. 4, first, the motor and fan unit 12 is moved toward the support structure 44 at an acute angle A relative to a common support axis B defined by the cylindrical openings 52, 66 of the support structure 44 and locking tab 48 and the semi-cylindrical surface 58 on the support member 46. Such movement of the motor and fan unit 12 brings the outer end 28A of the first mounting portion 28 of the motor and fan unit 12 into partial engagement in the bore 50 of the support structure 44. Next, as seen in FIG. 5, the flexible locking tab 48 is flexed and moved outwardly away from the support member 46 to the disengaging position. Following next, the motor and fan unit 12 is pivoted through the angle A downward toward the support axis B to place the second mounting portion 30 in a resting position onto the support surface 58 of the support member 46, as seen in FIG. 5. Concurrently therewith, the outer end 28A of the first mounting portion 28 of the motor and fan unit 12 is moved further into the bore 50 of the support structure 44 until it makes contact with the annular shoulder 50C therein, as seen in FIG. 6. Then, the locking tab 48 is released and, due to its inherent bias, moves inwardly from the disengaging position to the engaging position so as to lock the second mounting portion 30 in the opening 66 of the locking tab 48. Finally, the cover 24 is assembled to the support chassis 22 which places the outer bracket 76 in the blocking and confining positions relative to the locking tab 48, as seen in FIG. 6.

In view of the foregoing description, it can now be readily understood that the motor mounting arrangement 12 ensures that the motor and fan unit 12 cannot move laterally nor axially and will remain securely in place once mounted inside the housing of the vacuum cleaner.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

The embodiments of the invention in which an exclusive property or privilege is claimed are defined as follows:

1. An arrangement for mounting a motor and fan unit for use in a vacuum cleaner, said mounting arrangement comprising:

(a) a support substrate;

(b) a support structure attached to said support substrate and defining an opening for receiving a first mounting portion on a first end of the motor and fan unit;

(c) a support member attached to said support substrate and being spaced from said support structure, said support member having a recessed portion for receiving a second mounting portion on a second end of the motor and fan unit; and (d) a flexible locking tab attached to said support substrate and being disposed adjacent to said support member and movable between engaging and disengaging positions relative to the second mounting portion of the motor and fan unit, said locking tab having an opening for receiving the second mounting portion of the motor and fan unit when in said engaging position.

2. The arrangement of claim 1 wherein said support member includes a web portion attached to said support substrate with said recessed portion of said support member formed on an upper end of said web portion, said recessed portion including a concave surface for receiving the second mounting portion of the motor and fan unit.

3. The arrangement of claim 1 wherein said locking tab includes:

a lower base portion attached to said support substrate; and an upper locking portion having a pair of upright fingers defining said opening through said locking tab, said fingers attached to and extending upwardly from said lower base portion and curving inwardly toward one another so as to overlie the second mounting portion of the motor and fan unit received through said opening of said locking tab when said locking tab is in said engaging position.

4. The arrangement of claim 3 wherein said upright fingers of said upper locking portion define a passage through said upper locking portion to said opening for moving an end portion of a shaft of the motor and fan unit extending outwardly from the second mounting portion of the motor and fan unit through said passage to said opening while said locking tab is in said disengaging position.

5. The arrangement of claim 4 wherein said locking tab is biased to said engaging position and can be flexed outwardly to said disengaging position so as to permit the end portion of the motor and fan unit shaft to pass downwardly through said passage and to permit alignment of the second mounting portion of the motor and fan unit with said opening of the locking tab for insertion therein when said locking tab upon release returns to said engaging position to retain the flange of the second mounting portion of the motor and fan unit within said channel defined between said support member and said locking tab.

6. The arrangement of claim 1 wherein the support structure has a shoulder in said opening, the shoulder is adapted to abut the first end of the motor and fan unit to limit axial movement thereof in one direction relative to the support structure.

7. In combination with a vacuum cleaner including a support chassis and a motor and fan unit having a first mounting portion on a first end of said motor and fan unit, a second mounting portion on a second end of said motor and fan unit, an arrangement for enclosing said motor and fan unit and for mounting said motor and fan unit on said support chassis, said enclosing and mounting arrangement comprising:

(a) a support structure attached to said support chassis and defining an opening for receiving said first mounting portion of said motor and fan unit;

(b) a support member attached to said support chassis and spaced from said support structure, said support member having a recessed portion for receiving said second mounting portion of said motor and fan unit; and (c) a flexible locking tab attached to said support chassis and disposed adjacent to said support member, said locking tab being movable between engaging and disengaging positions relative to said second mounting portion of said motor and fan unit, said locking tab having an opening for receiving said second mounting portion of said motor and fan unit when in said engaging position.

8. The combination of claim 7 further comprising:

(d) a retaining bracket movable between assembled and disassembled conditions relative to said locking tab and said second mounting portion of said motor and fan unit, said retaining bracket having a first surface facing a side of said locking tab that faces away from said second mounting portion so as to block movement of said locking tab from said engaging position to said disengaging position when said retaining bracket is in said assembled condition.

9. The combination of claim 8 wherein the support structure defines a shoulder and the first mounting portion abuts the shoulder to limit the axial movement of the motor and fan unit in one direction.

10. The combination of claim 9 and further comprising:

a cover movable between said assembled and disassembled conditions relative to and with said support chassis; and the retaining bracket is attached to said cover.

11. The combination of claim 7 wherein said support member includes a web portion attached to said support chassis with said recessed portion of said support member formed on an upper end of said web portion, said recessed portion including a concave surface for receiving said second mounting portion of said motor and fan unit.

12. The combination of claim 7 wherein said locking tab includes:

a lower base portion attached to said support chassis; and an upper locking portion having a pair of upright fingers defining said opening through said locking tab, said fingers attached to and extending upwardly from said lower base portion and curving inwardly toward one another so as to overlie said second mounting portion of said motor and fan unit received through said opening of said locking tab when said locking tab is in said engaging position.

13. The combination of claim 12 wherein said upright fingers of said upper locking portion define a passage through said upper locking portion to said opening for moving an end portion of a shaft of said motor and fan unit extending outwardly from said second mounting portion of said motor and fan unit through said passage to said opening while said locking tab is in said disengaging position.

14. The combination of claim 13 wherein said locking tab is biased to said engaging position and can be flexed outwardly to said disengaging position so as to permit said end portion of said motor and fan unit shaft to pass downwardly through said passage and to permit alignment of said second mounting portion of said motor and fan unit with said opening of said locking tab for insertion therein when said locking tab upon release returns to said engaging position.

15. The combination of claim 7 wherein said second mounting portion defines a shoulder and said locking tab abuts said shoulder so as to prevent said motor and fan unit from shifting axially in one direction once mounted therein.

16. The combination of claim 15 wherein the support structure has a shoulder in said support structure opening in abutting relationship with the first end of the motor and fan unit to limit axial movement of the motor and fan unit with respect to the support structure in a second direction.

17. A method for mounting a motor and fan unit in a vacuum cleaner, comprising the steps of:

(a) providing a mounting arrangement including a support structure defining an opening for receiving a first mounting portion at a first end of the motor and fan unit, a support member spaced from said support structure and having a recessed portion for receiving a second mounting portion at a front end of the motor and fan unit, and a flexible locking tab disposed adjacent to said support member and movable between engaging and disengaging positions relative to the second mounting portion and having an opening for receiving the second mounting portion when in the engaging position, said support structure, support member and locking tab of said mounting arrangement being aligned along a common support axis having a length relatively greater than the axial length of a body portion of the motor and fan unit disposed between the first and second mounting portions;

(b) moving the motor and fan Unit at an angle to said support axis for partial engagement of the first mounting portion of the motor and fan unit into the opening of said support structure;

(c) moving said locking tab outwardly from said support member to the disengaging position;

(d) pivoting the motor and fan unit downward toward said common support axis to place the second mounting portion of the motor and fan unit onto said recessed portion of said support member and concurrently moving the first mounting portion of the motor and fan unit further into said opening in said support structure; and (e) releasing said flexible locking tab inwardly from said disengaged position to said engaged position so as to lock said second mounting portion in said opening in said locking tab.

18. The method of claim 17 wherein said flexible locking tab further includes a pair of upright fingers defining said opening of said locking tab, said fingers extending upwardly from a lower base portion and curving inwardly toward one another to overlie the second mounting portion received through said opening when said locking tab is in said engaging position.

19. The method of claim 17 wherein said upright fingers define a passage therebetween to said opening of said locking tab.

20. The method of claim 19 wherein said step of pivoting of the motor and fan unit further includes:

moving an end portion of a shaft of the motor and fan unit extending outwardly from the second mounting portion of the motor and fan Unit through said passage between the locking tab fingers to said opening while said locking tab is in said disengaging position.

21. The method of claim 17 wherein said flexible locking tab is biased to said engaging position.

22. The method of claim 17 and further comprising the steps of:

providing a cover for the support substrate movable between assembled and disassembled conditions relative thereto, said cover having a retaining bracket movable relative to the locking tab with movement of the cover between said assembled and disassembled conditions relative to the support substrate, said retaining member having a first surface facing a side of said locking tab that faces away from the second mounting portion of the motor and fan unit so as to block movement of said locking tab from said engaging position to disengaging position when said retaining member is in said assembled condition; and moving the cover to the assembled condition after the step of releasing the flexible locking tabs inwardly.

* * * * *